US005340171A

United States Patent [19]

Slaybuagh et al.

[11] Patent Number: 5,340,171

[45] Date of Patent: Aug. 23, 1994

[54] DOOR LATCH CONTROL APPARATUS WITH INDEPENDENT ACTUATORS

[75] Inventors: Loren E. Slaybuagh, Milwaukee; James M. Huffman, Greendale, both of Wis.

[73] Assignee: Republic Industries, Inc., Chicago, Ill.

[21] Appl. No.: 827,084

[22] Filed: Jan. 22, 1992

[51] Int. Cl.[5] ..... E05C 3/16

[52] U.S. Cl. ..... 292/21; 292/201; 292/DIG. 62; 292/92; 70/279

[58] Field of Search ..... 292/21, 92, 201, DIG. 62; 70/92, 279

[56] References Cited

U.S. PATENT DOCUMENTS

| | | | |
|---|---|---|---|
| 278,066 | 5/1883 | Wernert . | |
| 333,674 | 1/1886 | Rogers . | |
| 786,668 | 4/1905 | Nussbeck . | |
| 805,411 | 11/1905 | Clark . | |
| 824,173 | 6/1906 | Clark . | |
| 919,269 | 4/1909 | Voight . | |
| 943,973 | 12/1909 | Hope et al. . | |
| 975,456 | 11/1916 | Prevost . | |
| 984,458 | 2/1911 | Witham . | |
| 986,816 | 3/1911 | Girrens . | |
| 990,358 | 4/1911 | Hodgkinson . | |
| 1,010,689 | 12/1911 | Rogers . | |
| 1,014,960 | 1/1912 | Ericson . | |
| 1,016,502 | 2/1912 | Hoyaux . | |
| 1,039,734 | 10/1912 | Hannum . | |
| 1,056,937 | 3/1913 | Pratt . | |
| 1,069,075 | 7/1913 | Voight . | |
| 1,094,677 | 4/1914 | Page . | |
| 1,105,252 | 7/1914 | Carstens . | |
| 1,140,343 | 5/1915 | Arens . | |
| 1,165,436 | 12/1915 | Mochau . | |
| 1,168,792 | 1/1916 | Dyer . | |
| 1,197,111 | 9/1916 | Dyer . | |
| 1,306,560 | 6/1919 | Page . | |
| 1,346,670 | 7/1920 | Page . | |
| 1,441,336 | 1/1923 | Flowers . | |
| 1,539,350 | 5/1925 | Clark . | |
| 1,605,989 | 11/1926 | Rucker . | |
| 1,704,748 | 3/1929 | Kusch . | |
| 2,104,618 | 1/1938 | Hasenfuss | 292/93 |
| 2,146,968 | 2/1939 | Macagno | 292/144 |
| 2,320,298 | 5/1943 | Phillips | 292/92 |
| 2,328,936 | 9/1943 | White | 292/93 |
| 2,426,041 | 8/1947 | Moorhouse | 292/164 |
| 2,732,237 | 1/1956 | Kihn et al. | 292/67 |
| 2,765,648 | 10/1956 | Hatcher | 70/264 |
| 2,785,914 | 3/1957 | Thomas et al. | 292/7 |
| 2,871,050 | 1/1959 | Dickinson | 292/336.3 |
| 2,945,372 | 7/1960 | Reed | 70/92 |
| 2,962,889 | 12/1960 | McConnell | 70/92 |
| 2,992,846 | 7/1961 | Schwanz et al. | 292/127 |
| 3,024,053 | 3/1962 | Cox et al. | 292/21 |
| 3,083,560 | 4/1963 | Scott | 70/92 |
| 3,097,007 | 7/1963 | Eichacker et al. | 292/92 |
| 3,206,656 | 9/1965 | Musgrave | 317/172 |
| 3,228,069 | 1/1966 | Frueh | 20/23 |
| 3,432,631 | 3/1969 | Deutscher et al. | 200/61.67 |
| 3,464,728 | 9/1969 | Ruckel et al. | 292/92 |
| 3,521,921 | 7/1970 | Miyazaki | 292/201 |

(List continued on next page.)

FOREIGN PATENT DOCUMENTS

| | | |
|---|---|---|
| 65418 | 11/1982 | European Pat. Off. . |
| 182751 | 5/1986 | European Pat. Off. . |
| 8300523 | 2/1983 | PCT Int'l Appl. . |

*Primary Examiner*—Eric K. Nicholson

*Attorney, Agent, or Firm*—Willian Brinks Hofer Gilson & Lione

[57] ABSTRACT

A door latch control apparatus for use on a panic exit door allowing the door to be unlatched either manually or electrically is disclosed. Manual latch retraction is accomplished by pushing inwardly a push bar. Electrical latch retraction is accomplished by energizing a solenoid. A unique linkage system is provided to allow for the independent operation of the manual and electrical latch retraction. The apparatus also provides for the door to be dogged, i.e., securing the latch in the unlatched position, either manually or electrically. Manual dogging may be accomplished with the use of a fail safe dogging mechanism. Electrical dogging is accomplished by leaving the solenoid energized and thus the latch retracted.

13 Claims, 8 Drawing Sheets

U.S. PATENT DOCUMENTS

| | | | |
|---|---|---|---|
| 3,576,119 | 4/1971 | Harris | 70/271 |
| 3,583,740 | 6/1971 | Armstrong | 292/198 |
| 3,614,145 | 10/1971 | Zawadzki | 292/92 |
| 3,636,740 | 1/1972 | Rollins | 70/92 |
| 3,663,047 | 5/1973 | Zawadzki | 292/92 |
| 3,730,574 | 5/1973 | Zawadzki | 292/92 |
| 3,731,963 | 5/1953 | Pond | 292/144 |
| 3,743,898 | 7/1973 | Sturman | 317/154 |
| 3,751,086 | 8/1973 | Geringer | 292/144 |
| 3,753,316 | 8/1973 | Savarieau et al. | 49/31 |
| 3,767,238 | 10/1973 | Zawadzki | 292/21 |
| 3,776,582 | 12/1973 | Balducci | 292/92 |
| 3,788,687 | 1/1974 | Zawadzki | 292/92 |
| 3,805,451 | 4/1974 | Miller | 49/394 |
| 3,819,213 | 6/1974 | Vanderburgh | 292/21 |
| 3,854,763 | 12/1974 | Zawadzki et al. | 292/201 |
| 3,869,159 | 3/1975 | Eads | 292/92 |
| 3,877,262 | 4/1975 | Williams | 70/92 |
| 3,935,614 | 2/1976 | Pannone et al. | 16/48.5 |
| 3,973,744 | 8/1976 | Hintzman | 244/137 P |
| 4,006,471 | 2/1977 | Pappas | 340/274 |
| 4,081,980 | 4/1978 | Hightower | 70/92 |
| 4,083,590 | 4/1978 | Folger | 292/92 |
| 4,102,161 | 7/1978 | Proefrock | 70/42 |
| 4,130,306 | 12/1978 | Brkic | 292/5 |
| 4,167,280 | 9/1979 | Godec et al. | 292/92 |
| 4,181,335 | 1/1980 | Thoren | 292/92 |
| 4,185,859 | 1/1980 | Cunningham | 292/93 |
| 4,225,163 | 9/1980 | Hubbard et al. | 292/21 |
| 4,257,631 | 3/1981 | Logan, Jr. | 292/251.5 |
| 4,295,673 | 10/1981 | Miller | 292/21 |
| 4,324,425 | 4/1982 | Logan | 292/201 |
| 4,327,344 | 4/1982 | Luckenbach | 335/253 |
| 4,328,985 | 5/1981 | Logan | 292/201 |
| 4,384,738 | 5/1983 | Floyd | 292/92 |
| 4,427,223 | 1/1984 | Godec et al. | 292/92 |
| 4,437,693 | 3/1984 | Godec | 292/191 |
| 4,439,808 | 3/1984 | Gillham | 361/144 |
| 4,458,928 | 7/1984 | Hirshbein | 292/92 |
| 4,466,643 | 8/1984 | Godec et al. | 292/21 |
| 4,488,378 | 12/1984 | Symon | 49/141 |
| 4,491,354 | 1/1985 | Williams | 292/148 |
| 4,501,203 | 2/1985 | Lyngstrup | 109/635 |
| 4,506,407 | 3/1985 | Downey | 16/48.5 |
| 4,509,347 | 4/1985 | Young | 70/129 |
| 4,540,207 | 9/1985 | Klasen et al. | 292/341.17 |
| 4,545,606 | 10/1985 | Vodra | 292/92 |
| 4,546,628 | 10/1985 | Takasaki | 70/92 |
| 4,573,238 | 3/1986 | Phillips | 16/79 |
| 4,598,494 | 7/1986 | Tsuji et al. | 49/2 |
| 4,598,939 | 7/1986 | Krupicka et al. | 292/92 |
| 4,601,499 | 7/1986 | Kim | 292/36 |
| 4,624,490 | 11/1986 | Miller | 292/92 |
| 4,627,649 | 12/1986 | Leplat | 292/92 |
| 4,631,528 | 12/1986 | Handel et al. | 340/545 |
| 4,656,690 | 4/1987 | Katagiri et al. | 16/48.5 |
| 4,680,891 | 6/1987 | Perkins | 49/280 |
| 4,702,095 | 10/1987 | Ben-Asher | 70/279 |
| 4,709,950 | 12/1987 | Zortman | 292/92 |
| 4,715,146 | 12/1987 | Atsumi et al. | 49/1 |
| 4,741,563 | 5/1988 | Cohrs | 292/21 |
| 4,747,629 | 5/1988 | Miller | 292/92 |
| 4,785,286 | 11/1988 | Martin | 340/545 |
| 4,796,931 | 1/1989 | Heid | 292/92 |
| 4,801,163 | 1/1989 | Miller | 292/92 |
| 4,839,988 | 6/1989 | Betts et al. | 49/141 |
| 4,865,367 | 9/1989 | Choi | 292/92 |
| 4,875,722 | 10/1989 | Miller et al. | 292/92 |
| 4,881,766 | 11/1989 | Schmidt | 70/279 |
| 4,927,193 | 5/1990 | Miller | 292/92 |
| 4,961,330 | 10/1990 | Evans | 292/91 |
| 4,968,070 | 11/1990 | Choi | 292/92 |
| 4,976,476 | 12/1990 | Cross et al. | 292/92 |
| 5,011,199 | 4/1991 | Lowe et al. | 292/92 |
| 5,016,927 | 5/1991 | Toledo | 292/92 |
| 5,169,185 | 12/1992 | Slaybaugh et al. | 292/92 |

DOOR LATCH CONTROL APPARATUS WITH INDEPENDENT ACTUATORS

FIELD OF THE INVENTION

The invention generally relates to a device for manually or electrically unlatching a latch bolt normally biased to a latched position. More particularly, the invention relates to panic exit doors or fire doors, i.e., doors typically designed for use by large numbers of people and having a push bar to unlatch the door mounted at waist height. The invention is configured to be used in such doors so that they can be both manually unlatched by use of the push bar or electrically unlatched from a remote location. A unique linkage system is provided so each operation is independent of the other. The invention further allows for the door to remain unlatched, i.e., dogged, for extended periods of time.

BACKGROUND OF THE INVENTION

Panic exit devices of the type to which the invention relates commonly incorporate a push plate or bar, spanning the full width or portion of the width of the doorway which is pushed to unlatch and swing the door open.

By their name, the devices are typically used on doors of emergency exits, such as fire doors, or doors which are used to allow the passage of large crowds, such as in a gymnasium. The dependable and reliable operation of these devices is obviously crucial.

When the panic exit devices are provided to allow for the passage of a substantial number of people at one time, such as a gymnasium or arena door, it is advantageous to secure the device in the unlatched position, i.e., dogged. Dogging the door minimizes wear on the latching mechanism while also allowing for the door to immediately swing open upon pushing by an exiting person.

Because in installations where dogging is most desirable many panic exit doors are used, an efficient and simple method of dogging is demanded. Manually dogging of each panic exit door, although feasible, takes time. Typically, prior art manual dogging mechanisms required personnel to manually retract each door latch individually by pushing the push bar inward and then engaging the dogging mechanism. An example of such a mechanism is shown in Zawadzki, U.S. Pat. No. 3,730,574. In addition, any time spent by maintenance personnel manually dogging the doors also required at least equal time by maintenance personnel to undog them.

As a result, electrical latch control, including electrical dogging, is desirable. Namely, it can be done from a remote location, in minimal time and using minimal personnel. Such electric dogging devices are shown in Zawadzki, U.S. Pat. Nos. 3,854,763 and 3,767,238. These devices, however, require relatively complicated operating mechanisms. Moreover, it is desirable that dogging through an electric latch control device could be adapted to be used with any door latch mechanism, e.g. a rim latch or vertical rod latch. Finally, it is further desirable if a manual dogging capability could also be featured.

SUMMARY OF THE INVENTION

The present invention comprises an apparatus for either manually or electrically unlatching a latch bolt of a door. The apparatus features a novel linkage system allowing the door latch to be retracted either manually or electrically. The linkage system is of simple design and contains few parts so as to reduce manufacturing cost while increasing reliability.

The novel linkage system also allows for the independent manual and electrical operation of the door latch, particularly in that the condition of either one will not affect the ability of the door to be opened.

Moreover, as dogging is a desirable feature, the linkage system permits dogging to be accomplished either electrically or manually. Manual dogging is accomplished through a fail safe dogging mechanism by fixing the push bar in its innermost position, i.e., as it is when the door latch is unlatched. Alternatively, electrical dogging is accomplished through the provision of a solenoid. The solenoid is operatively connected to the door latch by the aforementioned linkage system. Energizing the solenoid thereby also unlatches the door. Moreover, the solenoid may be used to dog the door by simply leaving the solenoid energized, thereby retaining the door latch in the unlatched position. In such a condition, the door is dogged.

Also, the invention my be used in conjunction with various types of door latch assemblies, typically either a rim latch assembly (as shown in FIG. 1 of the accompanying drawings), or a vertical rod latch assembly (as shown in FIG. 7). Finally, while shown herein in use with push bar and door latch assemblies which are mounted to the exterior of the door, the invention can also be adapted to door latch assemblies mounted within the door body.

The foregoing features and the advantages of the invention will be further understood upon consideration of the following description of two preferred embodiments of the invention, taken in conjunction with the drawings.

DETAILED DESCRIPTION OF TWO PREFERRED EMBODIMENTS

Figure 1:
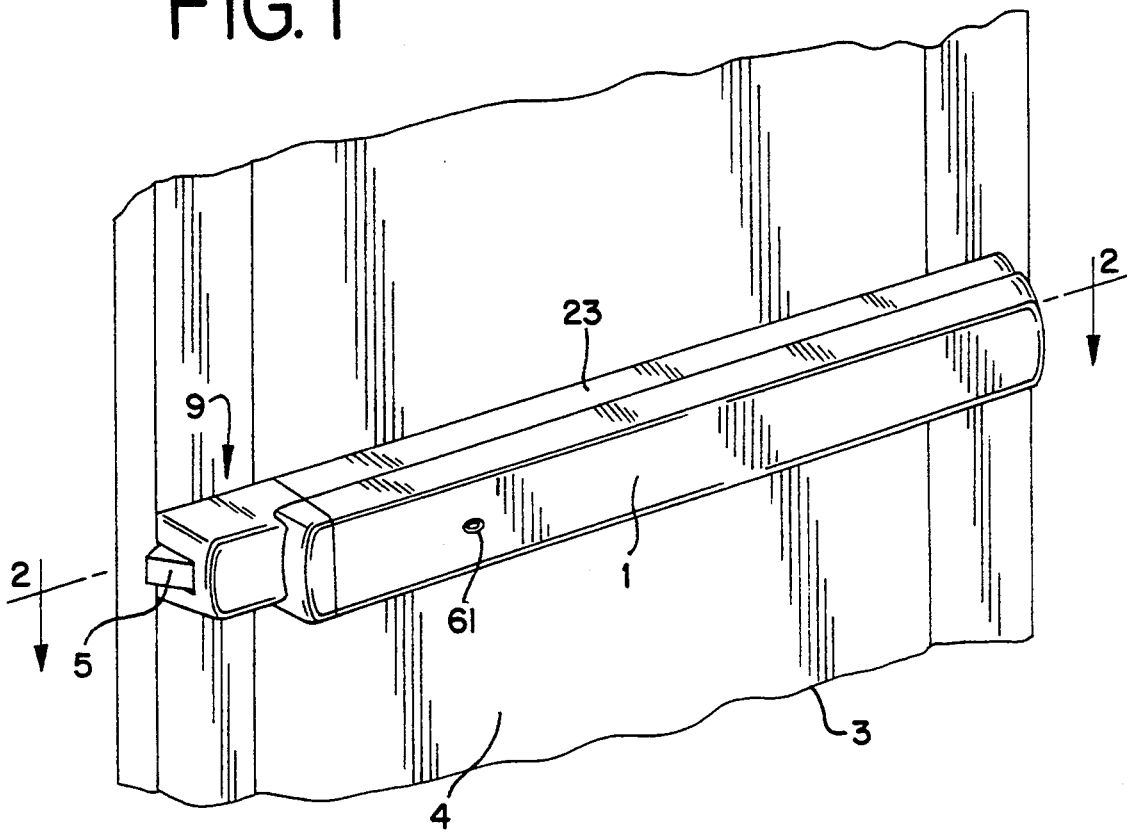
FIG. 1 is a perspective view of a panic exit apparatus made in accordance with the invention in use with a rim latch assembly and mounted to a door.
Figure 7:
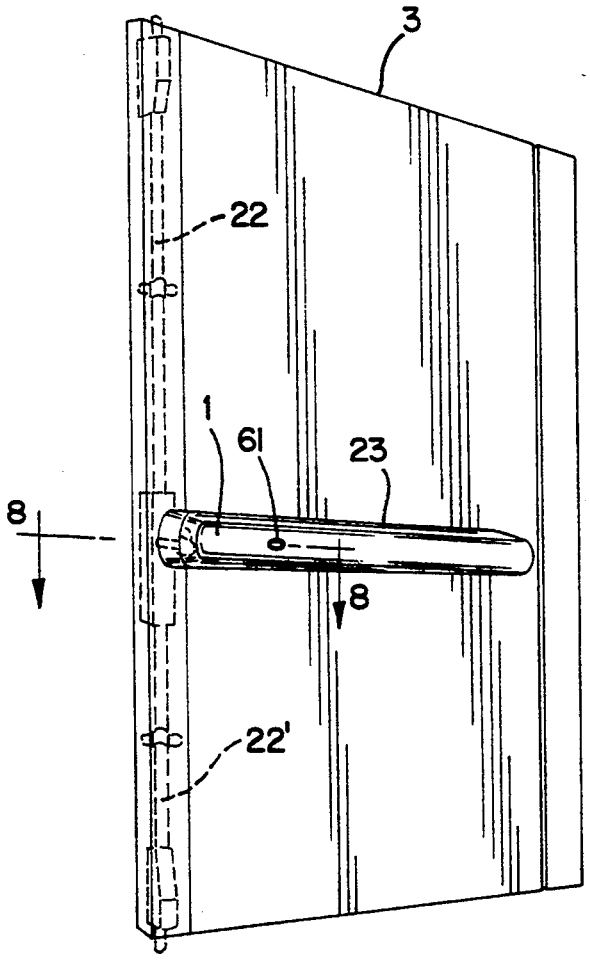
FIG. 7 is a perspective view of a panic exit apparatus made in accordance with the invention in use with a vertical rod latch assembly and mounted to a door.

FIG. 1 shows a first embodiment of the invention in a panic exit door 3 having a rim latch assembly 9. The apparatus can also be used on panic exit doors having other door latch assemblies, such as a vertical rod latch assembly, as shown in FIG. 7. Also, while shown herein as mounted to the exterior of the door 4, the invention can be adapted to be mounted within the door body.

The basic operation of a panic exit device consists of pushing a push bar 1 inward, or towards the door 3. The inward movement of the push bar is translated to retract the door latch 5, thereby allowing the door 3 to be opened.

The present invention provides for a door latch to be controlled two ways. Specifically, the present invention provides for the door latch to be retracted either manually, through use of a push bar, or electrically, through a solenoid. A unique linkage system allows for either operation independent of the other. The present invention further allows for the door latch to be secured in the retracted position, i.e., dogged, either manually or electrically.

Rim Latch Assembly

Figure 2:
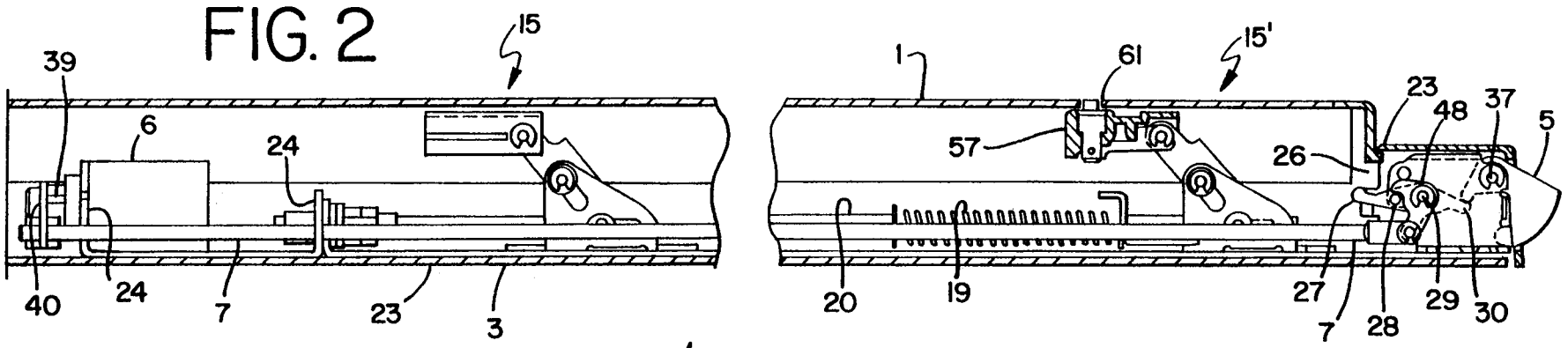
FIG. 2 is a sectional view of the apparatus generally taken along line 2—2 of FIG. 1.
Figure 6:
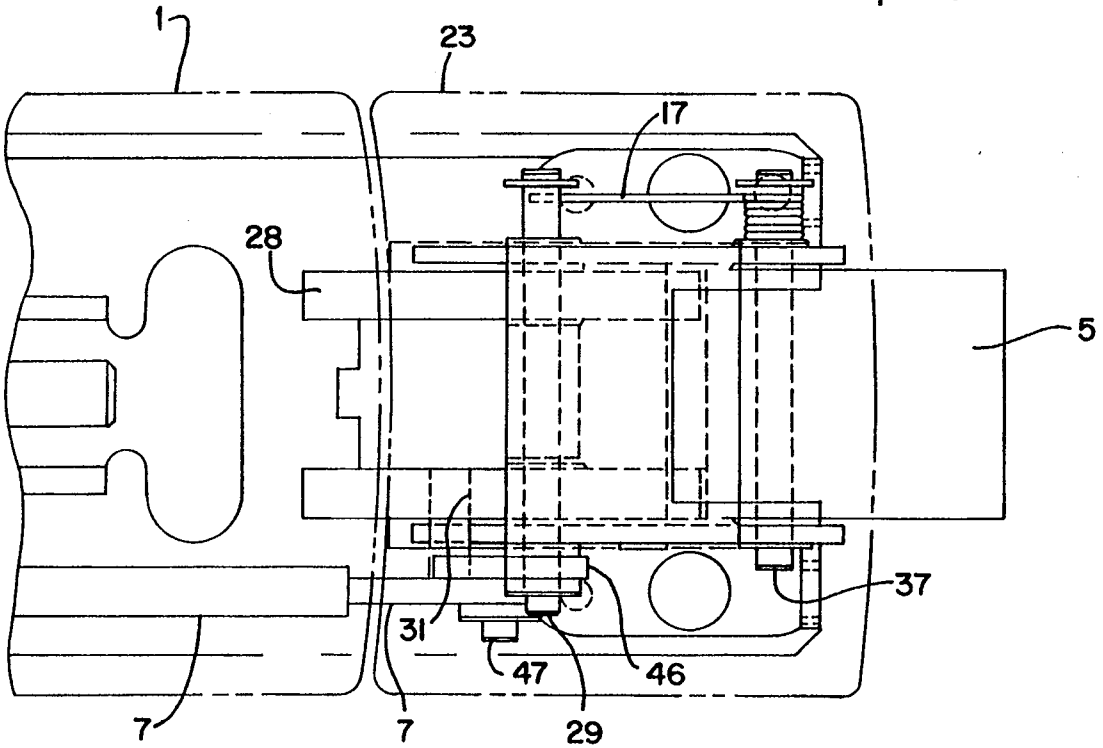
FIG. 6 is an enlarged fragmentary front elevational view of the apparatus of FIG. 1 showing the latch end.

The construction and operation of the invention in use with a rim latch assembly 9 is seen in FIGS. 1–6. FIG. 2 shows the apparatus with the push bar 1 biased outward, through spring 19 along actuator rod 20, and the solenoid 6 unactivated. In this state, the door latch 5 is in its latched position, being biased through the provision of spring 17 along pin 37, as seen in FIG. 6.

As seen in FIG. 2, a pair of guide links 15, 15′ are used to orthogonally translate the rectilinear movement of the push bar 1 (i.e., movement toward or away from the door) into side to side motion of the actuator rod 20. These guide links 15, 15′ further ensure that the face of the push bar 1 remains substantially parallel to the plane of the door 3, i.e., the entire push bar moves evenly upon pressure at only one end. A more detailed description of the guide links 15, 15′ and their operation may be found in U.S. Pat. No. 5,169,185 (Slaybaugh et al.). The type of guide links used to control the movement of the push bar forms only a general environment for the invention. Other embodiments of guide links may be used and are well within the skill of those in the art.

The electrical control of the door latch 5 is accomplished through the provision of a solenoid 6 mounted within the push bar housing 23 by bracket 24. Energizing the solenoid 6 moves the solenoid armature, or movable cone, 39 and thus the solenoid arm 40 to the right (as viewed in FIG. 2). The solenoid arm 40 is in turn connected to solenoid rod 7. Through a novel linkage system, the solenoid 6, as well as the push bar 1, may be independently used to retract the latch 5.

Figure 3:
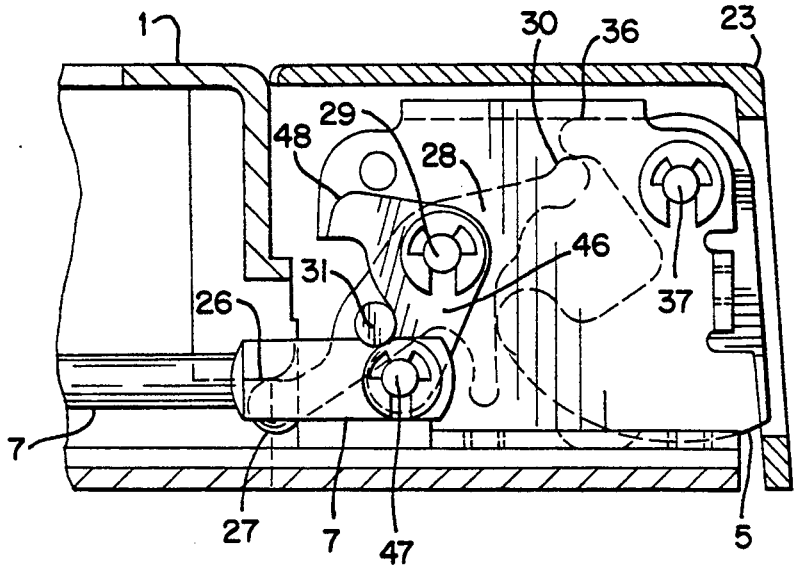
FIG. 3 is an enlarged fragmentary sectional view of the apparatus of FIG. 2 showing in detail the movement of the door latch when the push bar is pushed inward.
Figure 5:
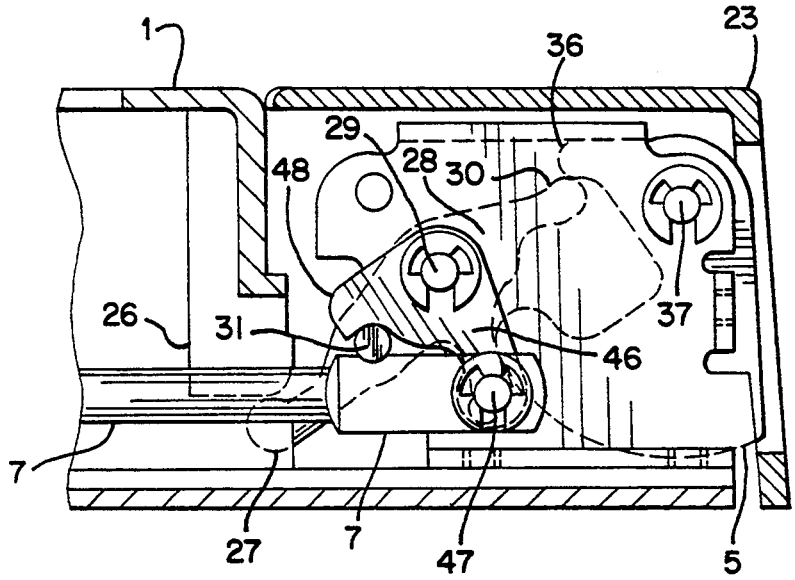
FIG. 5 is a fragmentary sectional view of the apparatus similar to FIG. 3 showing in detail the movement of the door latch with the solenoid energized and the push bar depressed.

FIG. 3 depicts the operation of the linkage system to manually unlatch the door latch 5. As seen, the push bar 1 has been manually pushed inwardly or towards the door 3, thereby causing the door latch 5 to retract. The latch actuator end cap portion 26 of the push bar 1 engages the end ball 27 of the pivot lever 28, rotating it counter-clockwise about the pin 29. Counter-clockwise rotation of the pivot lever 28 causes its end spur 30 to engage the latch spur 36 of the door latch 5, causing the door latch 5 to rotate about pin 37 in a clockwise direction and retract from its latched position.

Figure 4:
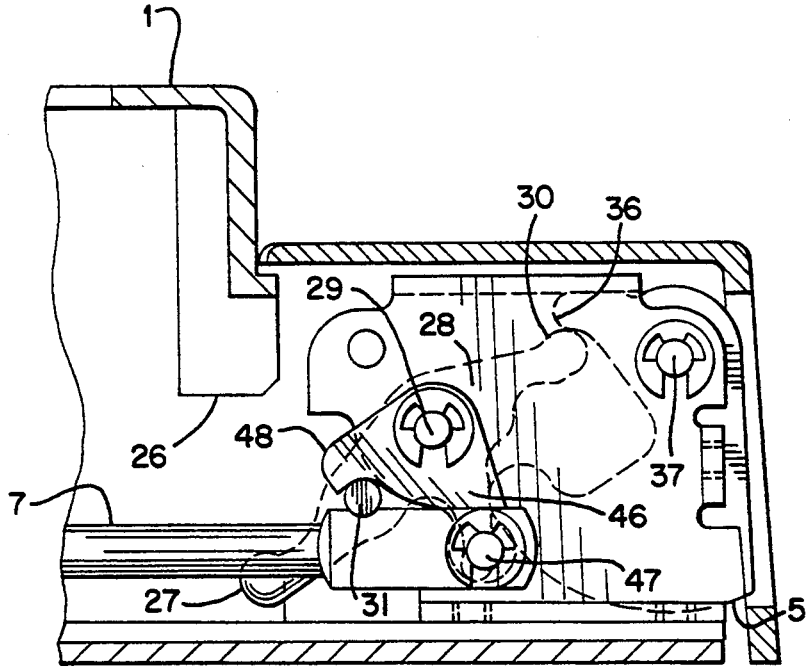
FIG. 4 is a fragmentary sectional view of the apparatus similar to FIG. 3 showing in detail the movement of the door latch when the solenoid is energized.

FIG. 4 depicts the operation of the linkage system when the door is electrically unlatched. As discussed previously, activation of the solenoid 6 moves the solenoid rod 7 to the right. The solenoid rod 7 is joined to drive link 46 through pin 47. Movement of the solenoid rod 7 to the right causes the drive link 46 to rotate counter-clockwise about pin 29. The rotation of the drive link 46, in turn, causes pivot arm 48 of the drive link to engage the midspur pin 31 of the pivot lever 28, thus also causing the pivot lever 28 to rotate counter-clockwise about the pin 29. As in the manual unlatching of the door latch 5, the end spur 30 of the pivot lever 28 engages the latch spur 36 of the door latch 5, causing the door latch to rotate about pin 37 in a clockwise direction and retract from its latched position.

To manually fix the apparatus in the unlatched position, i.e., dog the apparatus, a fail safe dogging mechanism is provided. This fail safe dogging mechanism allows the push bar 1 to be manually fixed to its dogged position only when the door latch 5 is already retracted to its unlatched position.

Figure 16:
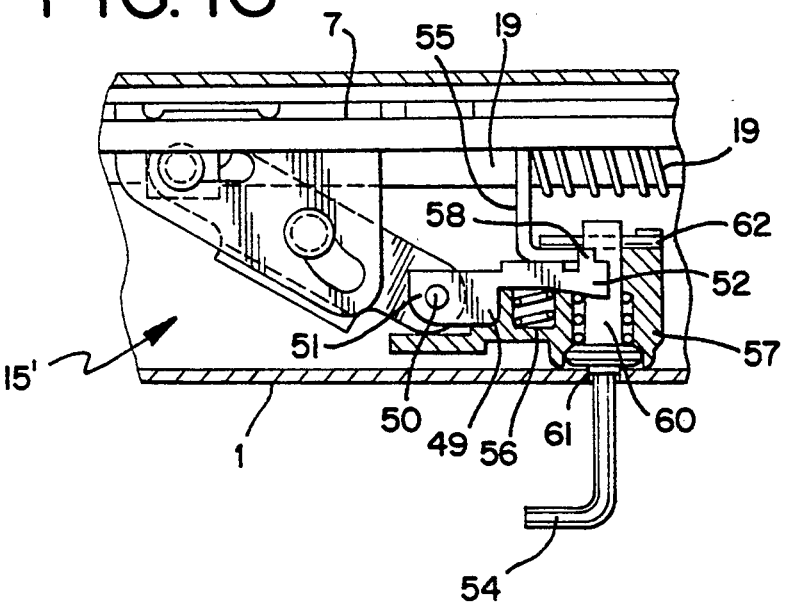
FIG. 16 is a fragmentary sectional view of the invention as it is when the push bar is depressed and the fail safe dogging mechanism has been rotated to retain the push bar in its depressed position to dog the door.
Figure 17:
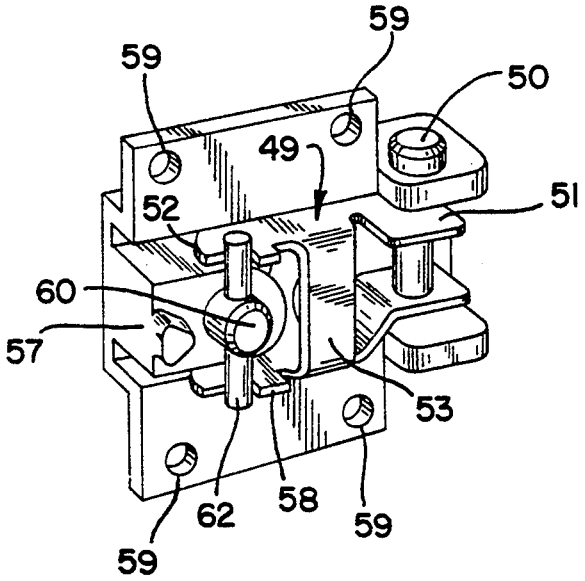
FIG. 17 is a perspective view of the fail safe dogging mechanism as seen looking outwardly from the door.

Specifically, and with reference to FIGS. 16 and 17 in particular, a fail safe clip 49 having two ends 51, 52 is pivotally mounted at end 51 by pin 50 to dogging bracket 57. Dogging bracket 57 in turn is fixed to the push bar 1 through use of the mounting holes 59. Thus the fail safe clip 49 is carried by the push bar 1 and mounted for pivotal movement about pin 50. The fail safe clip 49 is biased by a compression spring 56 into a position in which end 52 is pivoted away from the push bar 1. The fail safe clip 49 has a pair of spaced apart fingers 58 at end 52. These fingers 58 engage the ends of a dogging pin 62 carried by dogging axle 60 when the clip end 52 is biased away from push bar 1. In this fashion the fail safe clip 49 normally prevents rotation of the dogging axle 60. The dogging axle 60 may be rotated to retain the push bar 1 in its depressed position and thus dog the door latch 5, once the fail safe clip 49 is pivoted so that the fingers 58 do not interfere with the dogging pin 62.

The fail safe dogging feature works as follows: when the push bar 1 is in its resting position, i.e., biased outward by the spring 19, the clip 49 is biased by the spring 56 so that the fingers 58 engage and extend into the path of rotation of the dogging pin 62. This prevents the dogging axle 60 from being rotated into a dogged position. Otherwise, if the dogging axle 60 were rotated while the door 3 is still latched, the door could not be unlatched by simply pushing the push bar 1, since the dogging pin 62 would strike the catch 55 and prevent the push bar from being moved sufficiently inward to unlatch the door.

When the push bar 1 is pushed inwardly and the door latch 5 retracted, web 53 spanning between the fingers 58 of the fail safe clip 49 contacts the catch 55. At this time, the bias provided to the fail safe clip 49 by the spring 56 is overcome by the catch 55. The fail safe clip 49 is thereby pivoted toward the push bar 1. Only when the fingers 58 of the fail safe clip 49 are clear of the path of rotation of the dogging pin 62 can the dogging axle 60 be rotated into a dogged position. Rotation of the dogging axle 60 may be effected by a hex or Allen wrench 54 through opening 61 in the push bar 1. Thus, this feature ensures that the push bar 1 cannot be inadvertently or even intentionally dogged unless the door 3 is already unlatched. Further description and detail of this fail safe dogging mechanism is disclosed in U.S. Pat. No. 5,169,185 (Slaybaugh et al.), the disclosure of which is hereby incorporated by reference.

Electrical dogging of the apparatus is accomplished by leaving the solenoid 6 energized. In such a condition the solenoid rod 7 remains in the position shown in FIG. 4 and the door latch 5 remains unlatched.

The solenoid used is a D.C. pull-in type requiring 12 volts to pull in the armature and 4 volts to continuously withhold the armature. A suitable solenoid my be purchased from Regdon Solenoid Inc. of Westmont, Ill. Wires supplying power to the solenoid may be configured in any way known in the art. In the preferred embodiments the wires are run from the wall to the door and thus the solenoid through the hinges of the door.

Vertical Rod Assembly

Figure 8:
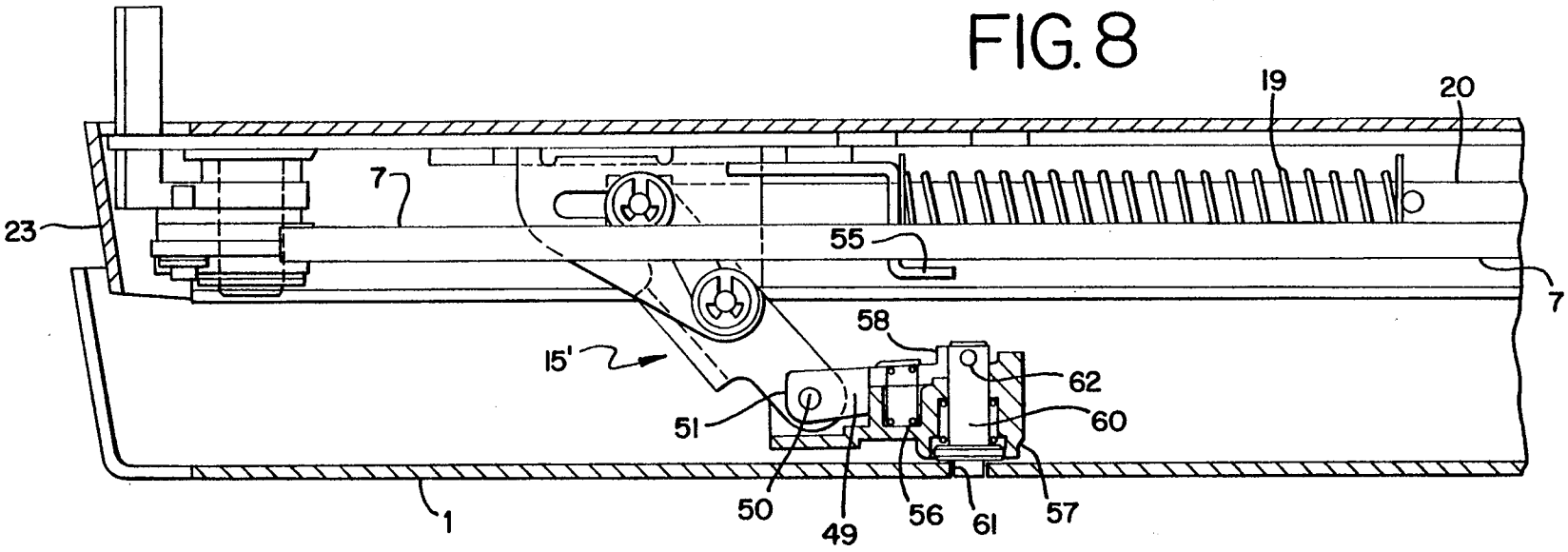
FIG. 8 is a partial sectional view of the apparatus of FIG. 7 taken along the line 8—8.

The construction and operation of the invention in use with a vertical rod assembly is seen in FIGS. 7–15. FIG. 8 shows the apparatus with the push bar 1 biased outward and the solenoid 6 unenergized. In this state the vertical rods 22, 22′ are in their latched or extended position as best seen in FIG. 7. Through the provision of spring 19, connected to the linkage system and thus the vertical rods 22, 22′ via the actuator rod 20, as best seen in FIG. 8, both the push bar 1 and the vertical rods are normally biased in their outward and latched positions respectively.

Figure 9:
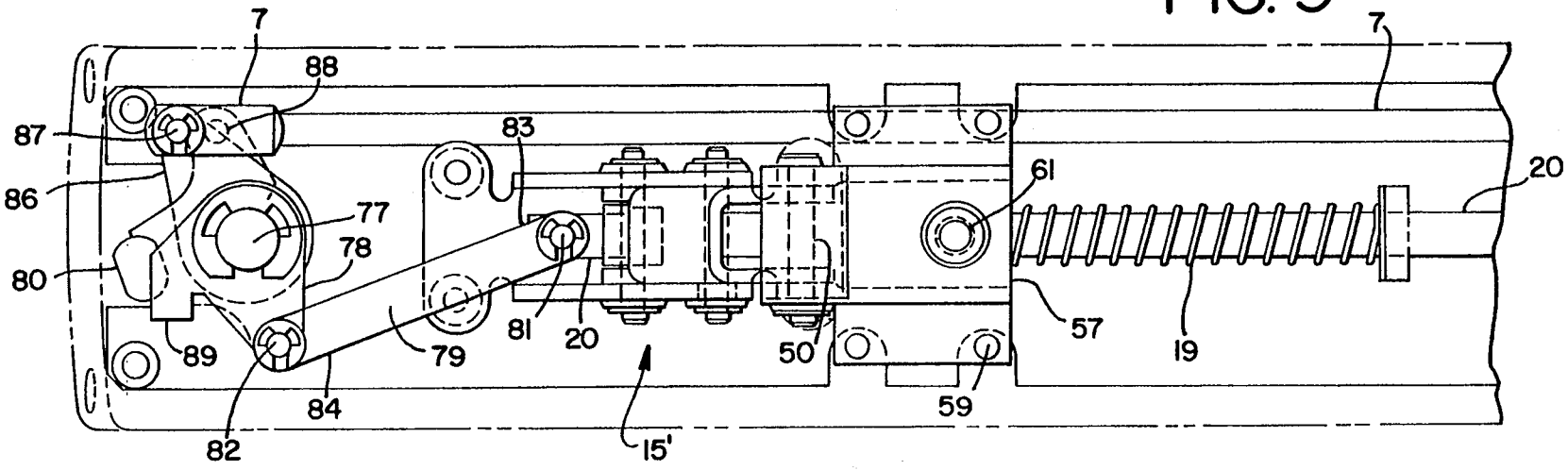
FIG. 9 is a sectional front elevational view of the apparatus similar to that of FIG. 8 showing the latch end as it is when the push bar is unactivated, the solenoid is unenergized and the door latch is in the latched position.
Figure 12:
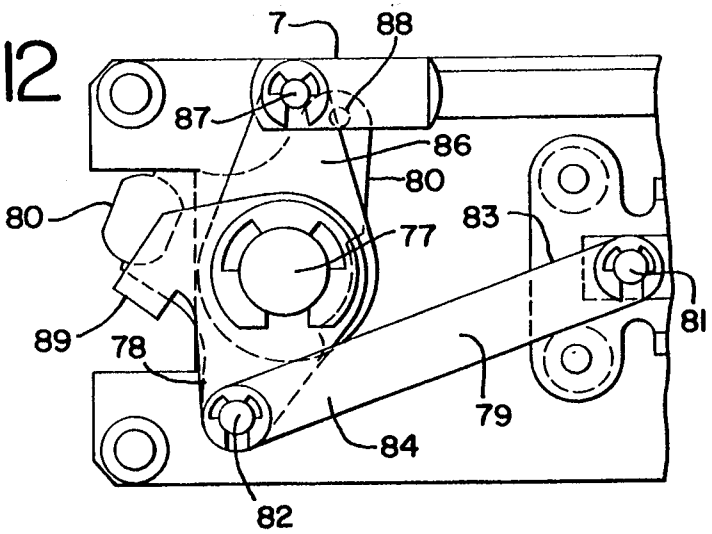
FIG. 12 is an enlarged fragmentary front elevational view of the apparatus of FIG. 9 having portions exposed for clarity and showing the end as it is when the push bar is depressed, the solenoid is energized and the door latch is retracted.
Figure 13:
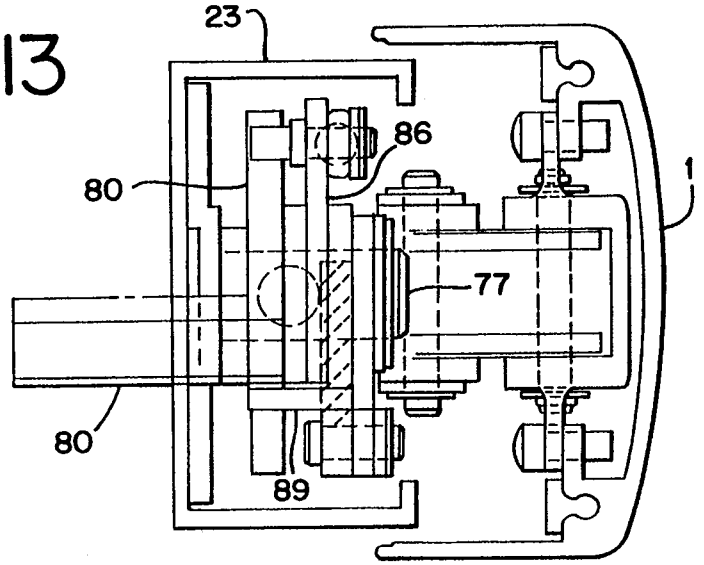
FIG. 13 is a sectional end view of the apparatus of FIG. 9 having portions exposed for clarity.
Figure 11:
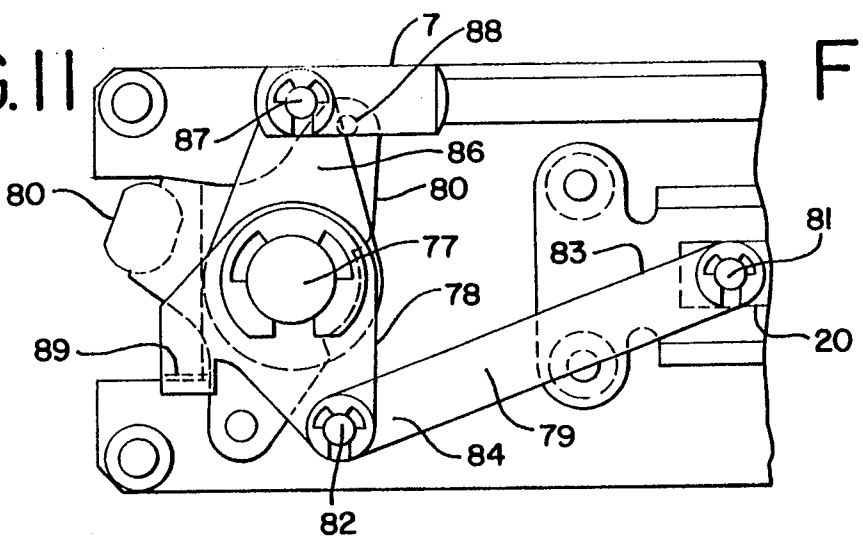
FIG. 11 is an enlarged fragmentary front elevational view of the apparatus of FIG. 9 having portions exposed for clarity and showing the end as it is when the solenoid is energized and the door latch is retracted.
Figure 10:
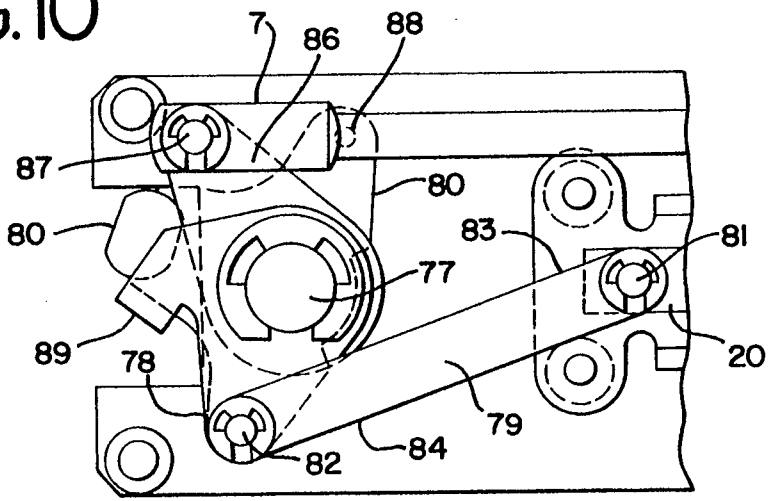
FIG. 10 is an enlarged fragmentary front elevational view of the apparatus of FIG. 9 having portions exposed for clarity and showing the end as it is when the push bar is depressed and the door latch is retracted.

In FIG. 10, a fragmentary sectional view of the apparatus showing the operation of the unique linkage system, the push bar 1 has been activated or pushed inward. Movement of the push bar 1 is transferred to the actuator rod 20 through the guide links 15, 15′ as best seen in FIGS. 8 and 9. The actuator rod 20 is connected to end 83 of a second latch actuator or crank 79 by pin 81. The crank 79 is in turn connected at its opposite end 84 to the push lever 78 by pin 82. The push lever 78 is mounted to rotate about axle 77. The push lever 78 features a push lever toe 89, as seen in FIGS. 10–12 and best seen in FIG. 13, which engages with the latch drive link 80. The latch drive link 80 is also mounted to rotate about axle 77. The latch drive link 80 is further connected to a mechanism, such as that disclosed in Miller, U.S. Pat. No. 4,295,673, to effect a releasing movement to the vertical rods 22, 22′. Thus, through the push lever toe 89, rotation of the push lever 78 causes the latch drive link 80 to also rotate. Through this linkage, movement of the push bar 1 is transmitted to move the vertical rods 22, 22′ to their unlatched position.

Figure 15:
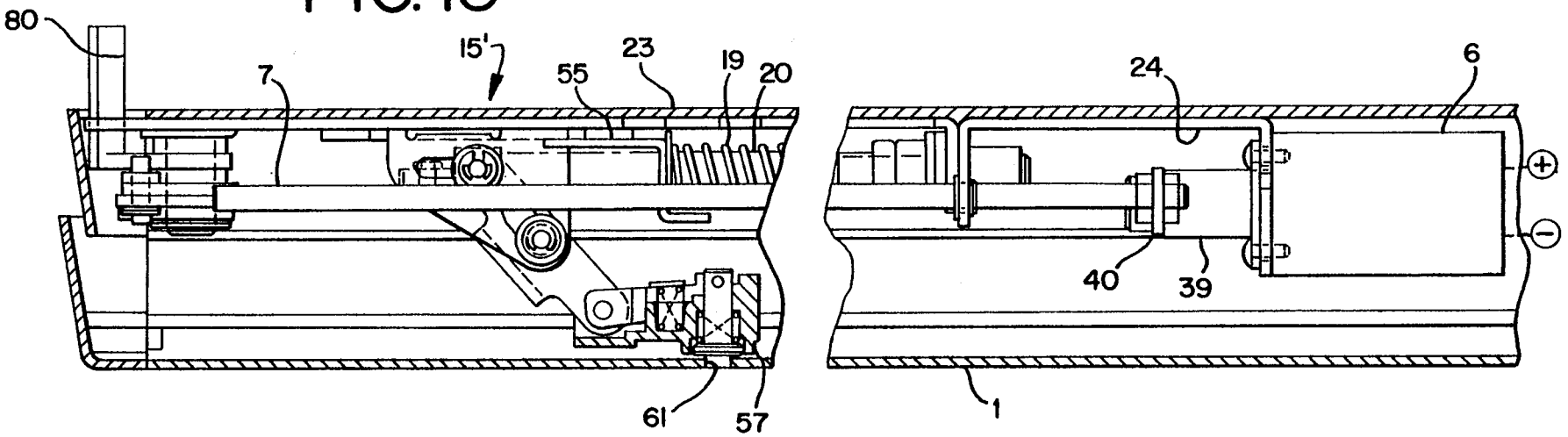
FIG. 15 is a top view in section of the apparatus of FIG. 7, with its mid-portion omitted for clarity.
Figure 14:
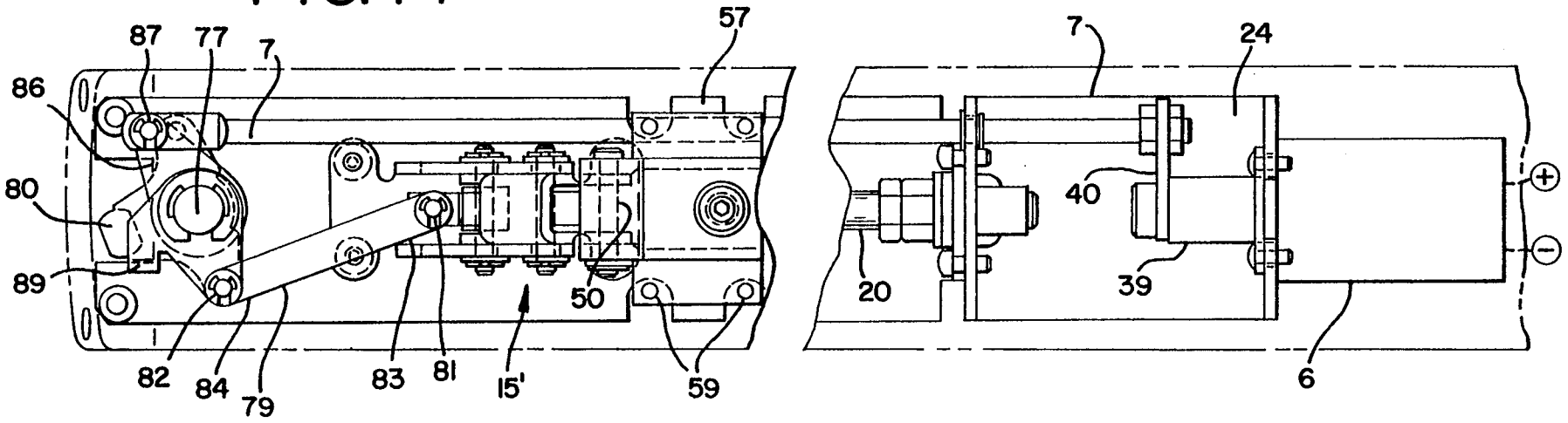
FIG. 14 is an enlarged front elevational view of the apparatus of FIG. 7, with its mid-portion omitted for clarity.

The electrical unlatching of the vertical rods 22, 22′ is depicted in both FIGS. 11 and 12. Electrical unlatching of the vertical rod embodiment differs from the rim latch embodiment in that the vertical rod embodiment has its solenoid 6 mounted in the opposite direction as that used in the rim latch embodiment, i.e., energizing the solenoid 6 moves the solenoid rod 7 to the right (as viewed in these Figures) through movement of the solenoid arm 40 attached to the solenoid armature 39, as seen in FIGS. 14 and 15. Movement of the solenoid rod 7 in turn rotates a solenoid lever 86 via connecting pin 87. Solenoid lever 86 rotates about axle 77. Through the engagement of a finger 88 on the latch drive link 80 by solenoid lever 86, rotation of the solenoid lever about axle 77 also causes the latch drive link 80 to rotate about axle 77. As noted above, the latch drive link 80 is connected to a mechanism to effect an unlatching movement to the vertical rods 22, 22′.

Electrical dogging of the vertical rods 22, 22′ is accomplished by leaving the solenoid 6 energized. In such a condition, the solenoid rod 7 remains in the position shown in FIGS. 11 and 12, and the vertical rods 22, 22′ remain in their unlatched position.

The vertical rod embodiment uses the same type of solenoid as the rim latch embodiment. Similarly, wires supplying power to the solenoid in the vertical rod embodiment are preferably run from the wall to the door and thus the solenoid through the door hinges. Of course, if desired the wires may be configured in any way known in the art.

Thus while the invention has been described in relation to particular embodiments, those having skill in the art will recognize modifications of materials, structure and the like which will still fall within the scope of the present invention.

I claim:

1. A latch control apparatus for a door comprising:

a latch movable between a latched position and an unlatched position;

a first latch actuator comprising a solenoid having an armature and movable from a first position wherein the latch is latched to a second position wherein the latch is unlatched;

a second latch actuator movable from a first position wherein the latch is latched to a second position wherein the latch is unlatched;

a linkage system for operatively connecting the first latch actuator to the latch and the second latch actuator to the latch so that movement of the first latch actuator from the first position to the second position will move the latch to the unlatched position independent of movement by the second latch actuator, and movement of the second latch actuator from the first position to the second position will move the latch to the unlatched position independent of movement by the first latch actuator;

wherein the linkage system comprises a drive link engaging the first latch actuator and movable between a first position and a second position, a pivot lever movable between a latched position and an unlatched position and engaging the second latch actuator and the latch, the pivot lever having a midspur pin positioned to engage the drive link and transfer movement of the drive link to the pivot lever and move the pivot lever from the latched position to the unlatched position and unlatch the latch.

2. A latch control apparatus for a door comprising:

a latch movable between a latched position and an unlatched position;

a first latch actuator movable from a first position wherein the latch is latched to a second position wherein the latch is unlatched;

a second latch actuator movable from a first position wherein the latch is latched to a second position wherein the latch is unlatched;

a linkage system for operatively connecting the first latch actuator to the latch and the second latch actuator to the latch so that movement of the first latch actuator from the first position to the second position will move the latch to the unlatched position independent of movement by the second latch actuator, and movement of the second latch actuator from the first position to the second position will move the latch to the unlatched position independent of movement by the first latch actuator;

wherein the linkage system comprises a first latch actuator lever engaging the first latch actuator and movable between a first position and a second position, a push lever engaging the second latch actuator and a latch drive link, the push lever being movable between a first position and a second position, the latch drive link engaging the latch and movable between a latched position and an unlatched position, the push lever having a toe positioned to engage the latch drive link and move the latch drive link from the latched position to the unlatched position and unlatch the latch, the latch drive link having a finger positioned to engage the first latch actuator and transfer movement of the first latch actuator to the latch drive link so as to move the latch drive link from the latched position to the unlatched position and unlatch the latch.

3. The apparatus of claim 2 wherein the first latch actuator comprises a solenoid having an armature.

4. The apparatus of claim 1 wherein the apparatus further comprises a manual dogging safety mechanism comprising a dogging axle mounted to the second latch actuator and movable between a dogged position and an undogged position to maintain the second latch actuator in the second position and maintain the latch in the unlatched position, and further wherein the solenoid armature is maintainable in the second position to maintain the latch in the unlatched position.

5. The apparatus of claim 3 wherein the apparatus further comprises a manual dogging safety mechanism comprising a dogging axle mounted to the second latch actuator and movable between a dogged position and an undogged position to maintain the second latch actuator in the second position and maintain the latch in the unlatched position, and further wherein the solenoid armature is maintainable in the second position to maintain the latch in the unlatched position.

6. A latch control apparatus for a door comprising:

a latch movable between a latched position and an unlatched position;

a solenoid having an armature movable from a first position wherein the latch is latched to a second position wherein the latch is unlatched;

a solenoid rod connected to the solenoid armature and movable from a first position wherein the latch is latched to a second position wherein the latch is unlatched;

a second latch actuator movable from a first position wherein the latch is latched to a second position wherein the latch is unlatched;

a linkage system connecting the solenoid rod and the second latch actuator to the latch, the linkage system comprising a drive link engaging the solenoid rod and movable between a first position and a second position, a pivot lever engaging the second latch actuator and the latch and movable between a latched position and an unlatched position, the pivot lever having a midspur pin positioned to engage the drive link and transfer movement of the drive link to the pivot lever and move the pivot lever from the latched position to the unlatched position and unlatch the latch.

7. The apparatus of claim 6 wherein the apparatus further comprises a housing and the second latch actuator comprises a push bar connected to the housing.

8. A latch control apparatus for a door comprising:

a latch movable between a latched position and an unlatched position;

a solenoid having an armature movable from a first position wherein the latch is latched to a second position wherein the latch is unlatched;

a solenoid rod connected to the solenoid armature and movable from a first position wherein the latch is latched to a second position wherein the latch is unlatched;

a second latch actuator movable from a first position wherein the latch is latched to a second position wherein the latch is unlatched;

a linkage system connecting the solenoid rod and the second latch actuator to the latch, the linkage system comprising a solenoid lever engaging the solenoid rod and movable between a first position and a second position, a push lever engaging the second latch actuator and a latch drive link and movable between a first position and a second position, the latch drive link engaging the latch and movable between a latched position and an unlatched position, the push lever having a toe positioned to engage the latch drive link and move the latch drive link from the latched position to the unlatched position and unlatch the latch, the latch drive link having a finger positioned to engage the solenoid rod and transfer movement of the solenoid rod to the latch drive link so as to move the latch drive link from the latched position to the unlatched position and unlatch the latch.

9. The apparatus of claim 8 wherein the apparatus further comprises a housing and the second latch actuator comprises a push bar connected to the housing.

10. A latch control apparatus for a door comprising:

a latching system movable from a latched position to an unlatched position;

first latch actuating means movable from a first position wherein a latch is latched to a second position wherein the latch is unlatched;

second latch actuating means movable from a first position wherein the latch is latched to a second position wherein the latch is unlatched;

means for operatively linking the first actuating means to the latching system and the second actuating means to the latching system so that movement of the first actuating means from the first position to the second position will move the latching system to the unlatched position without moving the second actuating means and movement of the second actuating means from the first position to the second position will move the latching system to the unlatched position without moving the first actuating means; and means for securing the latching system in the unlatched position comprising a solenoid having an armature movable from a first position in which the latching system is in the latched position to a second position in which the latching system is in the unlatched position, the solenoid armature further being maintainable in the second position.

11. A latch control apparatus for a door comprising:

a latching system movable from a latched position to an unlatched position;

first latch actuating means comprising a solenoid and movable from a first position wherein a latch is latched to a second position wherein the latch is unlatched;

second latch actuating means movable from a first position wherein the latch is latched to a second position wherein the latch is unlatched;

means for operatively linking the first actuating means to the latching system and the second actuating means to the latching system so that movement of the first actuating means from the first position to the second position will move the latching system to the unlatched position without moving the second actuating means and movement of the second actuating means from the first position to the second position will move the latching system to the unlatched position without moving the first actuating means, comprising a drive link engaging the first actuating means and movable between a first position and a second position, a pivot lever movable between a first position and a second position and engaging the second actuating means and the latching system, the pivot lever further engaging the drive link so that movement of the drive link moves the pivot lever from the first position to the second position thereby moving the latching system to the unlatched position; and means for securing the latching system in the unlatched position.

12. A latch control apparatus for a door comprising:

a latching system movable from a latched position to an unlatched position;

first latch actuating means movable from a first position wherein a latch is latched to a second position wherein the latch is unlatched;

second latch actuating means movable from a first position wherein the latch is latched to a second position wherein the latch is unlatched;

means for operatively linking the first actuating means to the latching system and the second actuating means to the latching system so that movement of the first actuating means from the first position to the second position will move the latching system to the unlatched position without moving the second actuating means and movement of the second actuating means from the first position to the second position will move the latching system to the unlatched position without moving the first actuating means, comprising a first latch actuator lever engaging the first actuating means and movable between a first position and a second position, a push lever engaging the second actuating means and a latch drive link and movable between a first position and a second position, the latch drive link engaging the latching system and movable between a first position and a second position, the push lever having a toe positioned to engage the latch drive link and move the latch drive link from the first position to the second position and thereby move the latching system to the unlatched position, the latch drive link having a finger positioned to engage the first actuating means and transfer movement of the first actuating means to the latch drive link so as to move the latch drive link from the first position to the second position and move the latching system to the unlatched position; and means for securing the latching system in the unlatched position.

13. A latch control apparatus for a door comprising:

a latching system movable from a latched position to an unlatched position;

first latch actuating means movable from a first position wherein a latch is latched to a second position wherein the latch is unlatched;

second latch actuating means movable from a first position wherein the latch is latched to a second position wherein the latch is unlatched;

means for operatively linking the first actuating means to the latching system and the second actuating means to the latching system so that movement of the first actuating means from the first position to the second position will move the latching system to the unlatched position without moving the second actuating means and movement of the second actuating means from the first position to the second position will move the latching system to the unlatched position without moving the first actuating means; and means for securing the latching system in the unlatched position comprising (1) a solenoid having an armature movable from a first position in which the latching system is in the latched position to a second position in which the latching system is in the unlatched position, the solenoid armature further being maintainable in the second position, and (2) a dogging safety mechanism comprising a dogging axle mounted to the second latch actuating means and rotatable between a dogged and undogged position, a dogging member extending from the axis of the axle, a dogging safety clip having a first position wherein the clip engages with the dogging member to prevent and axle from rotating to the dogged position and a second position wherein the clip does not prevent the axle from moving to its dogged position, and means for moving the clip from the first position to the second position in response to movement of the second latch actuating means from the first position to the second position.

* * * * *

UNITED STATES PATENT AND TRADEMARK OFFICE

CERTIFICATE OF CORRECTION

PATENT NO. : 5,340,171
DATED : August 23, 1994
INVENTOR(S) : Loren E. Slaybaugh

It is certified that error appears in the above-indentified patent and that said Letters Patent is hereby corrected as shown below:

On the Title Page

In each occurrence of the first inventor's name, please delete "Slaybuagh" and substitute --Slaybaugh--.

In the Claims

Column 10:

In claim 13, line 34, delete "and" and substitute --the--.

Signed and Sealed this

Sixth Day of June, 1995

Bruce Lehman

*Attest:*

BRUCE LEHMAN

*Attesting Officer*

*Commissioner of Patents and Trademarks*